United States Patent [19]

Nielsen et al.

[11] Patent Number: 4,796,933

[45] Date of Patent: Jan. 10, 1989

[54] WINDOW SASH WITH FRAME AND OPERATING HANDLE

[75] Inventors: Per G. Nielsen, Horsens; Elgård Nielsen, Østbirk; Steen Nygaard, Frederikssund, all of Denmark

[73] Assignee: V. Kann Rasmussen Industri A/S, Soborg, Denmark

[21] Appl. No.: 26,549

[22] PCT Filed: Jun. 11, 1986

[86] PCT No.: PCT/DK86/00062

§ 371 Date: Jan. 23, 1987

§ 102(e) Date: Jan. 23, 1987

[87] PCT Pub. No.: WO86/07404

PCT Pub. Date: Dec. 18, 1986

[30] Foreign Application Priority Data

Jun. 13, 1985 [DK] Denmark ..... 2663/85

[51] Int. Cl.[4] ..... E05C 17/18

[52] U.S. Cl. ..... 292/265; 292/DIG. 20; 52/72; 49/356

[58] Field of Search ..... 292/267, 268, 269, 270, 292/262, 265, 266, DIG. 20, DIG. 35; 49/394, 193, 356 X; 52/200, 72; 296/224

[56] References Cited

U.S. PATENT DOCUMENTS

| | | | |
|---|---|---|---|
| 1,845,014 | 2/1932 | Aurlie . | |
| 4,186,525 | 2/1980 | Carvalido | 49/394 |
| 4,289,343 | 9/1981 | Dukes | 292/262 |
| 4,486,978 | 12/1984 | Frank | 49/192 |
| 4,570,394 | 2/1986 | Jentoft et al. | 52/200 |

FOREIGN PATENT DOCUMENTS

| | | | |
|---|---|---|---|
| 449495 | 9/1927 | Fed. Rep. of Germany | 292/265 |
| 821607 | 10/1951 | Fed. Rep. of Germany . | |
| 2629219 | 6/1977 | Fed. Rep. of Germany . | |
| 51150 | 7/1932 | Norway | 292/265 |

*Primary Examiner*—Richard E. Moore
*Assistant Examiner*—Eric K. Nicholson
*Attorney, Agent, or Firm*—Lane & Aitken

[57] ABSTRACT

In a formed window sash (1) a holder (5) for an operating handle (11,12) is inserted between the frame and window glass (3) and an associated leaf spring (6,7) is provided to prevent an unintentional release of the handle after this has been mounted on the holder in that a slit portion (11) of the handle is stuck onto a stepped flap portion (9) of the holder.

5 Claims, 1 Drawing Sheet

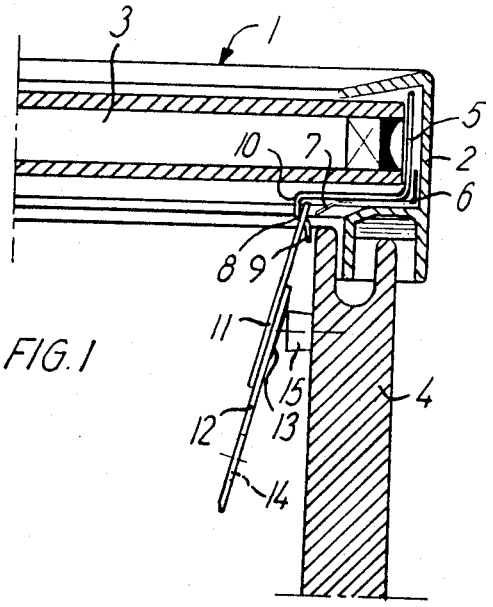
FIG. 1
FIG. 2
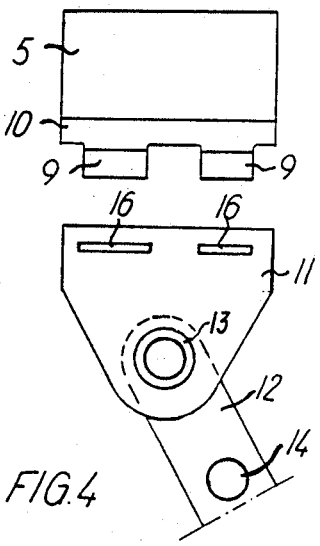
FIG. 4
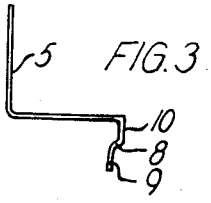
FIG. 3

WINDOW SASH WITH FRAME AND OPERATING HANDLE

This invention relates to a window sash consisting of a glass-supporting frame adapted to be hinged in a casing and provided with an operating handle to hold the sash at least in one position in relation to the casing. The handle may thus solely serve as a closure-means, but it may as well be a setting rod or a socalled casement stay.

Windows, including also window sashes separately, are increasingly manufactured by series or mass production in a relatively small number of sizes and frequently in such a manner that uniform window sashes may be used in connection with different types of casings. The purpose is obviously to entail a reduction of the cost price of the windows and of the required artisan's work at the site of installation. Window sashes may accordingly be completely finished in factory (i.e. glass and required frame fixture mounted), but it is then a demand that the factory also cares to deliver the windows in a perfect state to the purchaser, and this implies a compact and safe packaging of the window sashes either separately, e.g. as spare parts or exchange parts, or in an adequate, generally small number. In this respect the operating handle may be disadvantageous, firstly because it requires extra space with a view to packaging, secondly because it involves a certain risk of crushing the glass when handling the packed article.

It is the purpose of the invention to eliminate said inconveniences, i.e. so as to allow a space-saving and safe shipping of the window sashes to the site of use, and this is according to the invention obtained in that a holder is fixed between the frame and the glass, the handle being mountable on said holder by deformation of a securing spring attached to the holder and which when unloaded prevents the handle from being dismounted from the holder.

The mounting of the holder and of the spring may without noticeably complicating the work be effected in connection with the mounting of the glass, and the parts concerned generally lie within the frame thickness reckoned perpendicularly to the plane of the window sash so that they will not impede the packaging. A handle delivered along with the window sash or a handle already available at the site of use can easily and quickly be mounted or stuck on by overcoming the resiliency of the spring, following which said spring will protect the handle from falling off or being unintentionally released. On the other hand, an adequate manipulation of the spring makes it possible to detach the handle, for instance with respect to be re-used with an exchange window after glass crushing or if it is desired to mount a handle of another type or different look.

Further characteristic features of the window sash according to the invention will appear from the following description of an embodiment with reference to the drawing, in which FIG. 1 is a horizontal sectional view of the portion of a window sash opposite its hinge edge and with an operating handle and an adjacent casing portion, FIG. 2 is a plane view of a handle holder, FIG. 3 is a corresponding edge picture, and FIG. 4 is a plane view of the one end portion of the operating handle.

The window sash 1 fragmentarily illustrated in FIG. 1 includes a frame 2, e.g. of extruded or laminated aluminium, and an insulating pane 3 with two layers of glass mounted in said frame. The sash is supposed to be provided with hinges in its left side, not shown, allowing it to be swung open outwardly in relation to an associated casing 4.

When mounting the pane 3 a holder 5 is inserted between the pane and the inwards facing flange of the frame 2, see also FIGS. 2 and 3, said holder consisting of a piece of sheet metal bent into Z-shape and locally covering the edge of the pane and extending inwards along its inner surface to a point slightly beyond the inner edge of the frame, and an L-shaped leaf spring 6 is held between the frame and the holder and terminates in a tongue 7 bent outwards relative to the holder and pointing to a ledge 8 provided in an end portion 10 of the holder 5 presenting a pair of flaps 9 and extending approximately perpendicular to the glass pane 3. As it appears from FIG. 1 the flanges 9 end within the plane determined by the inwards facing edge (facing downwards on the drawing) of the frame.

In the illustrated embodiment the operating handle is composed of a piece of sheet 11 and a rod 12 rotatably connected with each other by means of a hollow rivet 13 that may be formed by the beaded edge of an opening in one of the parts. The hollow rivet 13 may be inserted on a retaining pin 15 in the casing. The rod 12 has a number of holes 14 having the same diameter as the retaining pin 15 so as to be engageable therewith in the same manner as the hollow rivet 13. The piece 11 comprises two aligned slits 16, the areas of which correspond to the cross-section of the two flaps 9 of the holder 5, and the mounting of the operating handle is effected quite simply in that the handle in a position substantially parallel to the pane 3 is displaced inwards on the flaps 9 until their ledges 8 fit into the slits 16, following which the handle is swung to the position illustrated in FIG. 1. This entails that the edge of the plate 11 parallel to the slits 16 slides past the spring tongue 7 due to its being slightly deformed, the handle being then secured against unintentional release from the holder, but it may, however, if desired, be dismounted by pushing back the resilient tongue.

In order to avoid wrong mounting the two flaps 9 may be unevenly wide and the two slits 16 unevenly long so as to prevent the handle from being mounted upside down. If this is considered unnecessary, a single flap and a corresponding slit will do.

When the window is closed and the hollow rivet 13 is in engagement with the pin 15, the rod 12 may be swung upwardly or downwardly and this rotating movement may, if desired, be utilized for pulling the frame against the casing and/or for locking up the window.

We claim:

1. A window sash to be hinged in an associated casing, comprising:

a frame;

a glass pane mounted in said frame, and having an inner side and an outer side;

a holder secured to the sash between said frame and said pane and by said frame and said pane and having a portion extending along said inner side of the pane past an inner edge of said frame;

an operating handle releasably mounted on said holder portion and adapted to hold the sash in at least one position relative to said casing; and means associated with said holder for allowing said operating handle to be mounted on said holder portion while preventing an unintentional removal of the holder therefrom, said means comprising a leaf spring.

2. A window sash as claimed in claim 1, characterized in that the holder (5) and the handle (11, 12) comprise, respectively, a flap portion (9) provided with a ledge (8) and extending approximately perpendicular to the pane (3), and a slit portion (11) insertable on said flap portion and defining a slit, and that the leaf spring (6) is inserted between the holder (5) and the frame (2) and has a free end (7) directed towards the ledge (8) of the flap portion, terminating at a distance from the ledge which is shorter than the distance of the slit from an edge of the slit portion (11) facing towards the spring.

3. A window sash as claimed in claim 2, characterized in that the holder (5) and the handle (11,12) comprise two unevenly wide flaps (9) lying in the same plane and two corresponding, unevenly long and aligned slits (16), respectively.

4. A window sash as claimed in claim 2, characterized in that the slit portion of the handle is a sheet piece (11) with which a handle piece (12) is rotatably connected by a hollow rivet (13) for engagement with a retaining pin (15) on the casing (4).

5. A window sash as claimed in claim 3, wherein the slit portion of the handle is a sheet piece (11) with which a handle piece (12) is rotatably connected by a hollow rivet (13) for engagement with a retaining pin (15) on the casing (4).

* * * * *